US010900627B1

(12) United States Patent
Cullimore

(10) Patent No.: US 10,900,627 B1
(45) Date of Patent: Jan. 26, 2021

(54) APPARATUS AND METHOD FOR SIMULATED 3D FLAME EFFECT

(71) Applicant: Jay N. Cullimore, Ft. Lauderdale, FL (US)

(72) Inventor: Jay N. Cullimore, Ft. Lauderdale, FL (US)

( * ) Notice: Subject to any disclaimer, the term of this patent is extended or adjusted under 35 U.S.C. 154(b) by 0 days.

(21) Appl. No.: 16/836,871

(22) Filed: Mar. 31, 2020

(51) Int. Cl.

| | |
|---|---|
| ***F21S 10/04*** | (2006.01) |
| ***F21V 23/00*** | (2015.01) |
| ***F21V 5/04*** | (2006.01) |
| ***F21V 23/06*** | (2006.01) |
| ***F21S 6/00*** | (2006.01) |
| ***F21Y 113/17*** | (2016.01) |
| ***F21Y 115/10*** | (2016.01) |
| ***F21Y 107/30*** | (2016.01) |
| ***F21W 121/00*** | (2006.01) |

(52) U.S. Cl.
CPC ..... *F21S 10/043* (2013.01); *F21S 6/001* (2013.01); *F21V 5/043* (2013.01); *F21V 23/009* (2013.01); *F21V 23/06* (2013.01); *F21W 2121/00* (2013.01); *F21Y 2107/30* (2016.08); *F21Y 2113/17* (2016.08); *F21Y 2115/10* (2016.07)

(58) Field of Classification Search
CPC ..... F21S 6/001; F21S 10/04; F21S 10/043; F21V 5/043; Y10S 362/81
See application file for complete search history.

(56) References Cited

U.S. PATENT DOCUMENTS

| | | | | |
|---|---|---|---|---|
| 5,924,784 | A * | 7/1999 | Chliwnyj | F21V 3/04 362/234 |
| 6,337,946 | B1 * | 1/2002 | McGaffigan | B29D 11/00663 362/555 |
| 6,926,423 | B2 * | 8/2005 | Bucher | H05B 45/00 362/184 |
| 7,726,860 | B2 * | 6/2010 | Harrity | F21S 10/04 362/555 |
| 9,644,815 | B2 * | 5/2017 | Thijssen | F21V 5/02 |
| 10,371,326 | B2 * | 8/2019 | Grandadam | H05K 1/144 |
| 10,514,141 | B1 * | 12/2019 | Ostrander | F21S 10/043 |
| 2007/0242473 | A1 * | 10/2007 | Lee | G02B 6/0096 362/551 |
| 2008/0130266 | A1 * | 6/2008 | DeWitt | A61L 9/12 362/96 |
| 2011/0310587 | A1 * | 12/2011 | Edmond | G02B 6/0003 362/84 |
| 2013/0271989 | A1 * | 10/2013 | Hussell | F21V 29/65 362/249.02 |
| 2014/0268704 | A1 * | 9/2014 | Yang | G09F 13/00 362/185 |
| 2014/0268802 | A1 * | 9/2014 | Sun | F21V 5/04 362/294 |
| 2016/0327227 | A1 * | 11/2016 | Green, Jr. | F21S 10/043 |
| 2017/0059119 | A1 * | 3/2017 | Bennett | F21V 3/02 |
| 2020/0240604 | A1 * | 7/2020 | Patton | F21V 3/0625 |

* cited by examiner

*Primary Examiner* — Alexander K Garlen
(74) *Attorney, Agent, or Firm* — Lorusso & Associates

(57) ABSTRACT

Apparatus and method for creating a natural flame effect using an RGB LED light source and lenses. The output of individually controlled LEDs operated by a simulated-flame-motion algorithm to simulate flame motion is enhanced with the use of multilayer lenticular lens filters to refract the light waves emitted by the LEDs in a manner to create a natural-acting 3D flame effect.

20 Claims, 7 Drawing Sheets

APPARATUS AND METHOD FOR SIMULATED 3D FLAME EFFECT

CROSS-REFERENCE TO RELATED APPLICATIONS

None.

FIELD OF THE INVENTION

This disclosure relates generally to electronically-controlled simulated light emitting apparatus. More particularly, the disclosure relates to methods and apparatus for enhanced computer-controlled LED light systems used to simulate candle light and flames.

BACKGROUND OF THE DISCLOSURE

A lenticular lens is an array of linear rows of magnifying lenses, designed so that when viewed from slightly different angles, different images are magnified. The lenses used in lenticular printing are a common example. Use of this technology gives an illusion of depth-images appear to change or move as the image is viewed from different angles. Multiple lenses are used to create this effect.

Currently available artificial candles and flame-effect products used to simulate a flame typically only display a varying pulsing light output diffused by a substrate of wax or plastic as a diffusion medium. These methods of candle-light simulation are typical in most current designs in the market place and lack the realism of an actual moving flame as one would see, for example, in a gas-fired torch flame. In related products such as artificial fireplaces, a mechanical moving backdrop/screen or vapor mist may be employed to create the visual effect of flame.

Still other products that produce a flame effect employ multiple LEDs arranged in a circular pattern and controlled by an algorithm to simulate a flame. The outgoing light is diffused by a single layer diffuser that may be a flat smooth non-lenticular lens or by a lenticular lens constructed to primarily reduce "hot spotting" only and not to produce a 3D appearance. In still other designs, a flame effect is achieved through the use of moveable mechanical light reflectors operated by magnetic coils or other means where a light source is reflected by the reflector for direct viewing or reflected to a translucent surface to show random light movement and thus simulate flame motion.

By way of example, relevant art reference, U.S. Pat. No. 9,689,544 to Green, Jr. et al., issued Jun. 27, 2017, discloses a three-dimensional carrier that includes an array with a plurality of light sources distributed on it. A control circuit coordinates on/off activation/deactivation of the light sources in a manner that simulates a jumping flame. In one embodiment, the three-dimensional carrier and LEDs are encapsulated in a partially light-transmissive cover. Although the apparatus represents an improvement over older flame-simulation systems, the effect is limited due to the absence of any true light-refraction features. The use of a LEDs in a circular pattern on a cylindrical surface with a diffuser does not impart the kind of depth expected from a 3D flame effect. The Green apparatus will not create a good 3D effect, but a simulation of movement of light intended to mimic a flame effect from any angle over 360°.

Another relevant art reference, U.S. Pat. No. 9,454,624 to Kim et al., issued Sep. 27, 2016, discloses a system and method for simulating a sequence of discrete natural effects, whereby each natural effect of the sequence is based on an initial natural effect, an immediately preceding natural effect, and a time interval between the immediately preceding natural effect and the initial effect. The initial effect is a two-dimensional simulated natural effect and one or more second consecutive simulated natural effects is a three-dimensional simulated natural effect. There are no structural features such as lenses to enhance the appearance of the computer-simulated flame effect.

In yet another relevant art reference, United States Patent Application No. 20050155262 A1 to Mix et al., issued Jul. 21, 2005, a lenticular fireplace and methods for simulating a fire within a fireplace are disclosed. In one embodiment, a fire is simulated with a lenticular screen. The lenticular screen includes a lenticular lens layer and an image layer, wherein the image layer comprises one or more images of a fire. A device is coupled to the lenticular screen that moves the lenticular screen to alter a viewed image of the fire. In another embodiment, the lenticular screen is disposed within a fireplace enclosure. In yet another embodiment, a fireplace includes a convertible heated glass apparatus. The apparatus is used in a front wall of an enclosure. The Mix system is essentially a projected backlit flame image that does not have the ability to simulate the 3D features of true flames.

What is needed is a flame simulation apparatus that creates true-to-life simulated 3D flames via a novel combination of electronic and structural means. These and other objects of the disclosure will become apparent from a reading of the following summary and detailed description of the disclosure.

SUMMARY OF THE DISCLOSURE

In one aspect of the disclosure, lenticular lensing is incorporated into a novel complex arrangement to produce a 3D flame effect. Unlike in the printing method to produce depth and movement using a basic orientation of a single lenticular flat sheet, this disclosure demonstrates using multiple lenticular lenses with unique orientations relative to each other in a non-flat configuration and multiplane layout.

In another aspect of the disclosure, a light source formed from multiple RGB LEDs positioned in an array simulate the complex movement of heat and visible flame illumination. A sequential LED algorithm turns on the LEDS in random patterns of variable groupings that randomly vary in length and number to simulate how fire cools over time in a random manner as it moves up from an ignition point. The speed of repetition or spark from the bottom source point is random as well. The LEDS also vary the color based upon the simulated variances in heat temperature during the process. With the combination of complex lensing with an algorithm controlling the light source, a realistic and 3D flame effect is produced in a 360-degree viewing angle.

In a further aspect of the disclosure, a simulated electronic flame apparatus is disclosed in which the apparatus includes a light source algorithm and lenticular diffusion diffraction filters to electronically produced light or illumination that mimics the characteristics of a natural flame. This apparatus can be powered by battery or AC including a power-on sensor, and remote-control communication media to control the duration, brightness, color and intensity of the simulated flame effects. These and other aspects of the disclosure will become apparent from a review of the appended drawings and a reading of the following detailed description of the disclosure.

DETAILED DESCRIPTION OF THE DISCLOSURE

Figure 1:
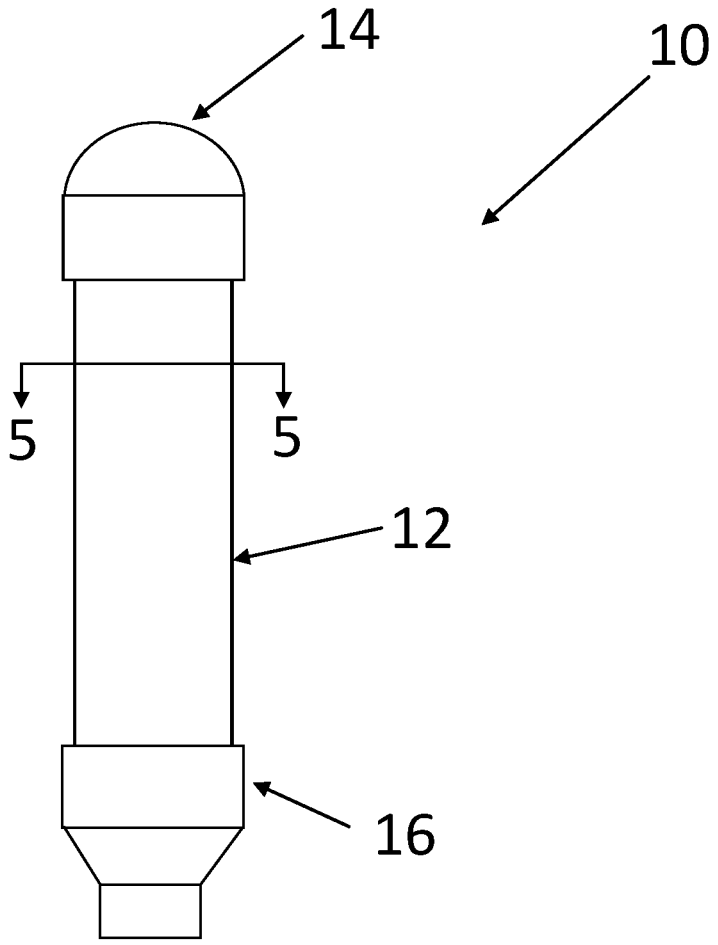
FIG. 1 is a side view in elevation of a simulated flame apparatus according to one embodiment of the disclosure.

Referring to FIG. 1, in one aspect of the disclosure, a flame-effect apparatus shown generally as 10 is disclosed. Flame-effect apparatus 10 includes a housing 12 that may be tubular or conform to any regular or irregular geometric shape in cross-section. Housing 12 also may be formed with sections along its length having different geometric shapes in cross-section. The transitions between the sections may be smooth or abrupt such as square to rectangular with sharp delineations. Housing 12 is an illumination and viewing surface made of a material such as acyclic, polycarbonate or other clear, transparent or translucent material known in the art. It should be understood these material selections are illustrative and not limiting. Whatever material is selected to construct housing 12, it should be sufficiently rigid to provide a mechanical structure to mount a lenticular lens 18 on the inside surface of housing 12. To close the ends of housing 12, a top end cap 14 and a bottom end cap 16 are secured to the housing ends. The means used to secure the housing ends to the housing may be friction fit, interference fit, such as with bayonet-type locking features, and/or adhesive. Top end cap 14 and bottom end cap 16 are hollow and provide mounting surfaces to attach, house and protect control electronics (not shown).

Figure 2:
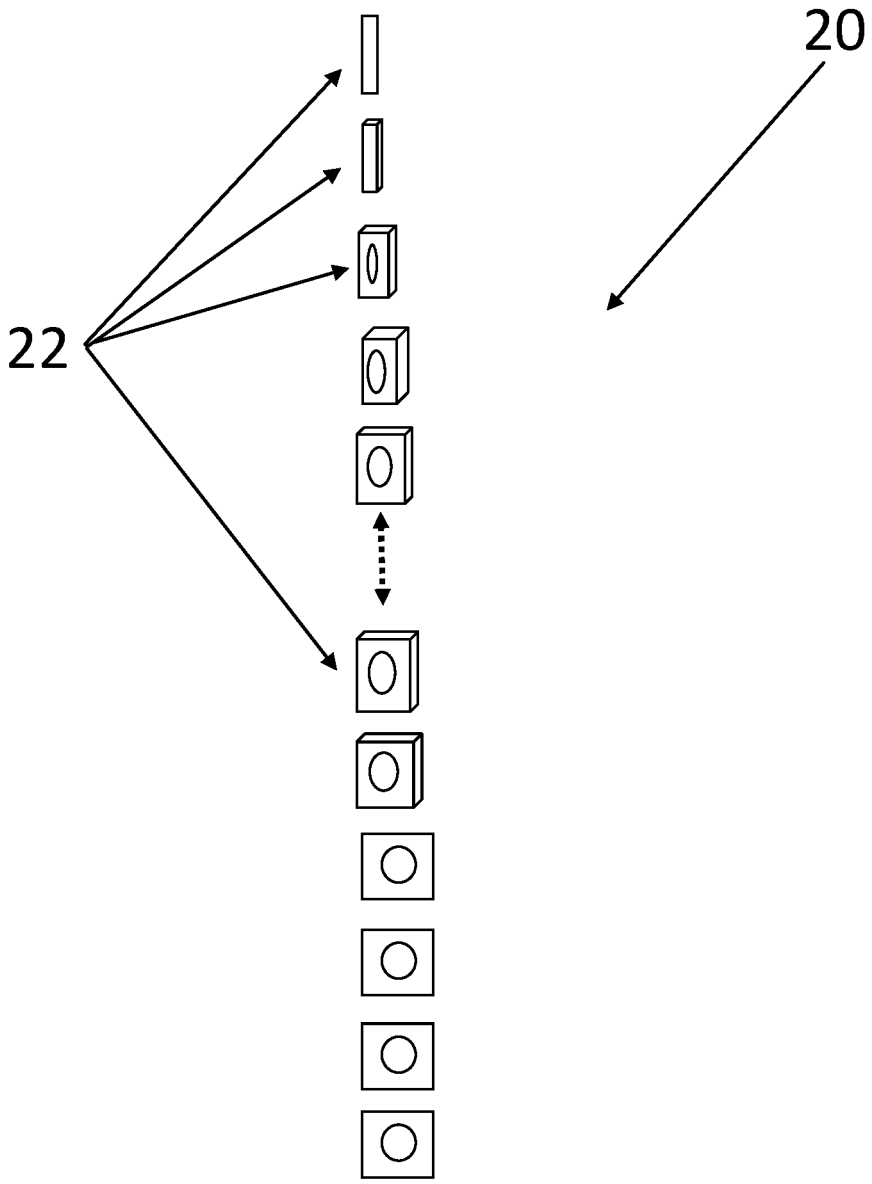
FIG. 2 is an exploded view of a plurality of RGB LEDs configured in a helix-shaped LED assembly according to the embodiment of the disclosure shown in FIG. 1.

Referring now to FIG. 2., an addressable LED assembly 20 is shown. LED assembly 20 is formed from a series of individual red, green and/or blue (RGB) LEDs 22 connected together in a strip to form a straight, or alternatively, a helix pattern. LEDs 22 are addressable in that they can be individually controlled. By incorporating a slight twist or helix configuration to the LED train, illumination projected by the LEDs will vary the light progression from the bottom to the top of the LED train. This creates an effect of light movement and increases the total dispersion angle. The number of LEDs used will vary depending upon the resolution required and based upon the illumination area defined. The more LEDs used, the better the resolution obtained. If the highest LED resolution per meter is desired, the number of LED assemblies 20 can be increased from one to multiple LED strips per assembly. If multiple LED strips are used, each LED strip may have independent, dedicated drivers and algorithms controlling each strip and each LED separately to further create randomness and 3D effects while increasing the overall brightness level.

To conform LED assembly 20 to a helical shape, the assembly is secured to a rigid support strip 24 twisted into a helical shape. The LED strip can be secured to the rigid strip with an adhesive, double-backed tape, or like adhesion means. The rigid strip may be metallic or polymer based. An aluminum strip has proven to be adequate for this purpose and has the added advantage of functioning as a heat sink needed for high output LEDs. A bottom end 26 of strip 24 may be secured to a printed circuit board 28 to provide a direct connection between the LED assembly 20 and the PCB 28. Bottom end 26 anchors LED assembly 20 in the approximate center of housing 12 although it can be positioned offset from the center.

To anchor a top end 27 of strip 24, a plate 29 is secured to top end 27. The ends of plate 29 are secured to an inner wall of outer lens 18 to lock in the position of strip 24 relative to outer lens 18. Any means can be used to secure strip 24 to plate 29 including the use of adhesives, welding, interlocking features and the like. Similar means can be used to secure plate 29 to outer lens 18. With this combination of features, strip 24 can be centered relative to the cross-sectional center of outer lens 18. In this manner the longitudinal axis of strip 24 and therefore, LED assembly 20, can be maintained in a parallel orientation with the longitudinal axis of outer lens 18.

Figure 3:
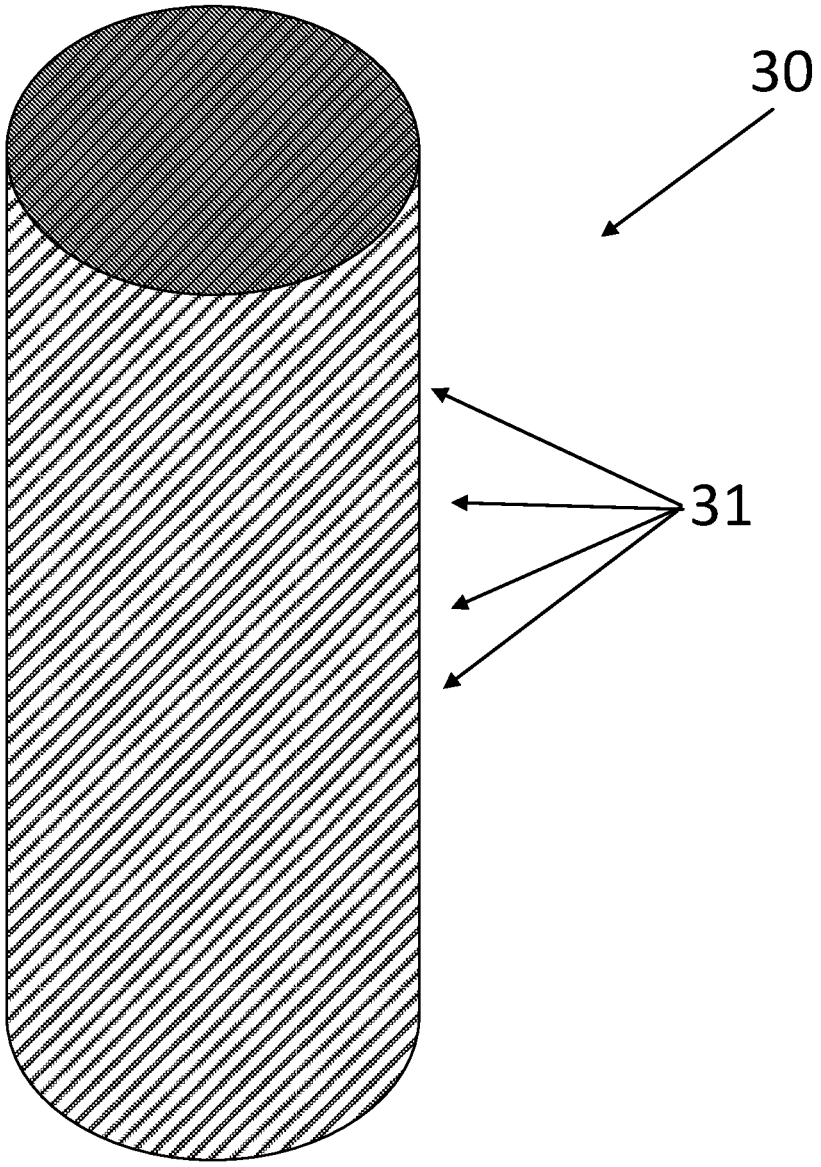
FIG. 3 is a perspective view of an inner lenticular lens having a cylindrical shape with lens linear ribs positioned off angle from a horizontal or cross-sectional reference.

Referring now to FIG. 3, an inner center lenticular lens 30 is substantially cylindrical in shape but may conform to any regular or irregular geometric shape in cross-section. The cross-sectional shape of lens 30 does not have to conform to the cross-sectional shape of outer lenticular lens 18. By using different shapes for the two lenses, additional modifications of the light forms projected by the apparatus may be achieved. Inner lens 30 has a cross sectional diameter less than the cross-sectional diameter of outer lens 18 to permit inner lens 30 to fit within outer lens 18.

Outer lenticular lens 18 is formed with a plurality of substantially parallel ribs 19 oriented in parallel with a horizontal axis of the lens or orthogonal to the longitudinal axis of lens 18. Ribs 19 alternatively may be converging or diverging and/or may be oriented at an angle relative to the longitudinal axis of lens 18. In a further embodiment, ribs 19 may be formed on the external or internal surfaces of lens 18. In yet another embodiment, ribs 19 may be formed in random patterns including overlapping patterns to produce refracted light variations.

Internal lenticular lens 30 is formed with a plurality of internal lens ribs 31, internal or external, that may be oriented in parallel and horizontal relative to a longitudinal axis of the lens or may be oriented in parallel at an angle relative to the longitudinal axis or a horizontal axis of the lens. Ribs 31 may also be converging or diverging and oriented collectively parallel with the horizontal axis of the lens or oriented at an angle relative to the horizontal axis of the lens. Ribs 31 may also extend in random patterns including overlapping patterns to produce numerous light refraction variations. The orientation of internal lens ribs 31 may or may not be parallel with ribs 19 on outer lenticular lens 18.

Figure 4:
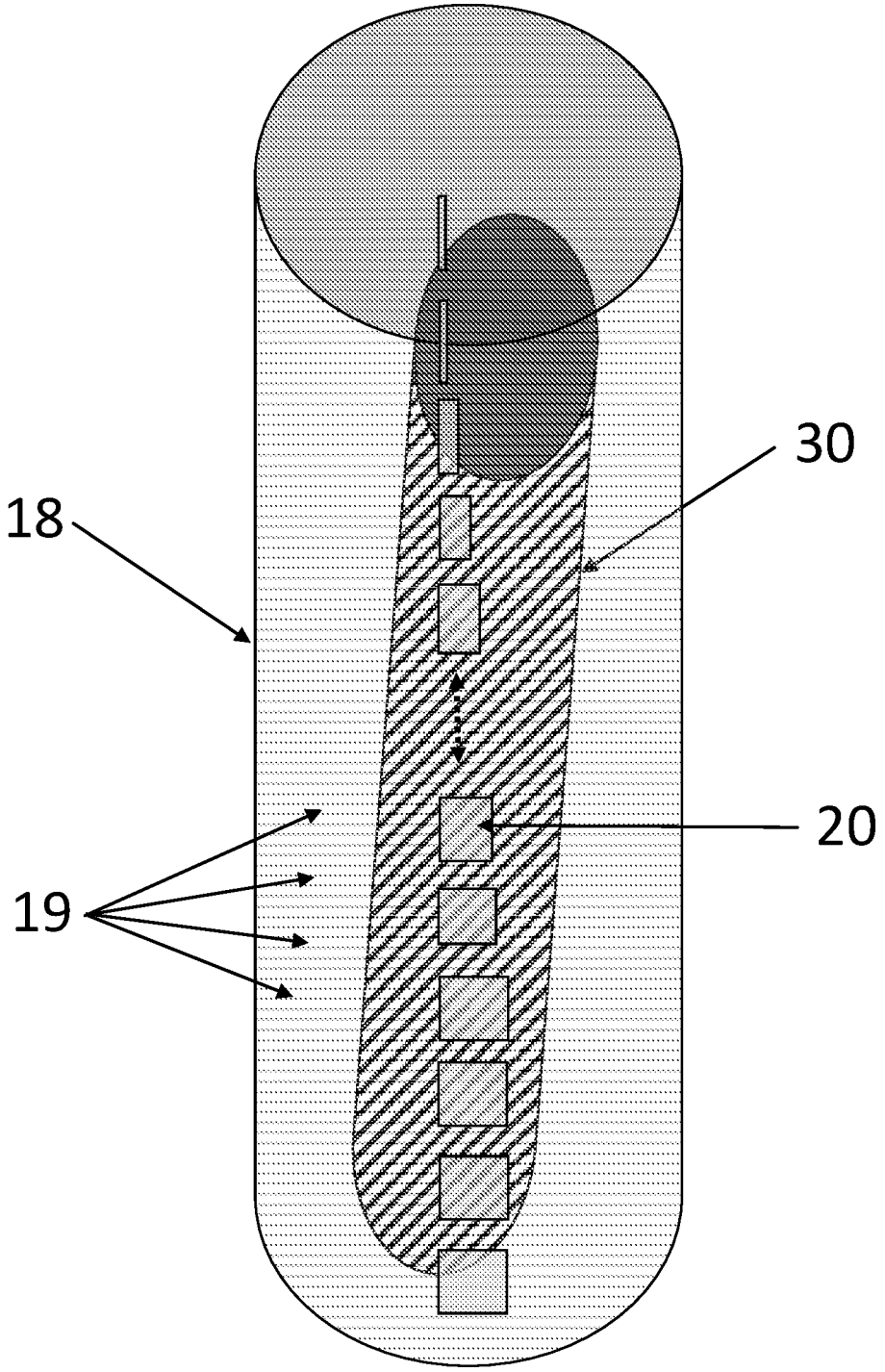
FIG. 4 is a side perspective view with partial phantom shading showing an outer lenticular lens enclosing an inner lens and an RGB LED light source according to the embodiment of the disclosure shown in FIG. 1.

Referring now to FIG. 4, flame-effect apparatus 10 includes outer lens 18 enclosing inner lens 30 and LED assembly 20. As shown, outer lens 18 and LED assembly 20 are mounted in a vertical relationship with their longitudinal axes substantially parallel. Inner lens 30 is mounted with its longitudinal axis not parallel to the parallel longitudinal axes of LED assembly 20 and outer lens 18. This offset orientation of inner lens 30 relative to outer lens 18 produces a more true-to-life simulated flame.

Figure 5:
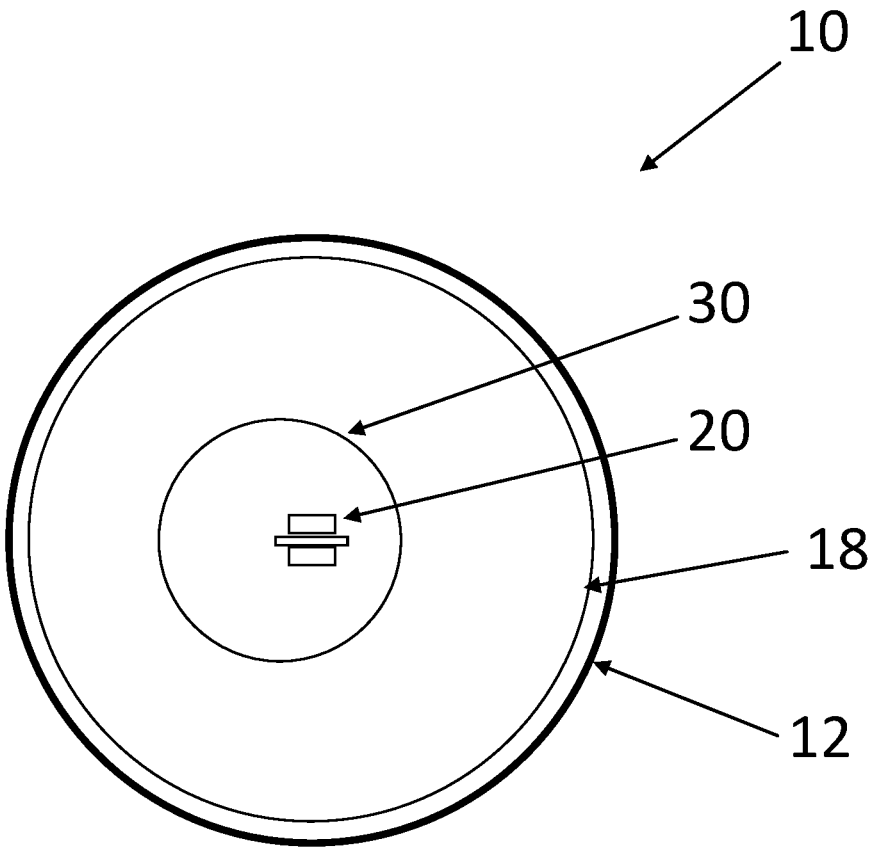
FIG. 5 is a top view of the orientation and spatial relationship between a LED strip and a lenticular lens in a simulated flame apparatus according to the embodiment of the disclosure shown in FIG. 1.

Referring now to FIG. 5., the relative orientation and position of RGB LED assembly 20 and outer lenticular lens 18 in housing 12 is shown. The outside clear housing 12 used as part of the housing and to hold outer lenticular lens 18. Toward a center axis of housing 12 is inner lenticular lens 30. Inner lens 30 can be positioned away from the center axis and located anywhere in the housing so as to modify the light effect provided by outer lens 18. LED assembly 20 is positioned in the center of the assembly but may be positioned offset from the center of housing 12.

Figure 6:
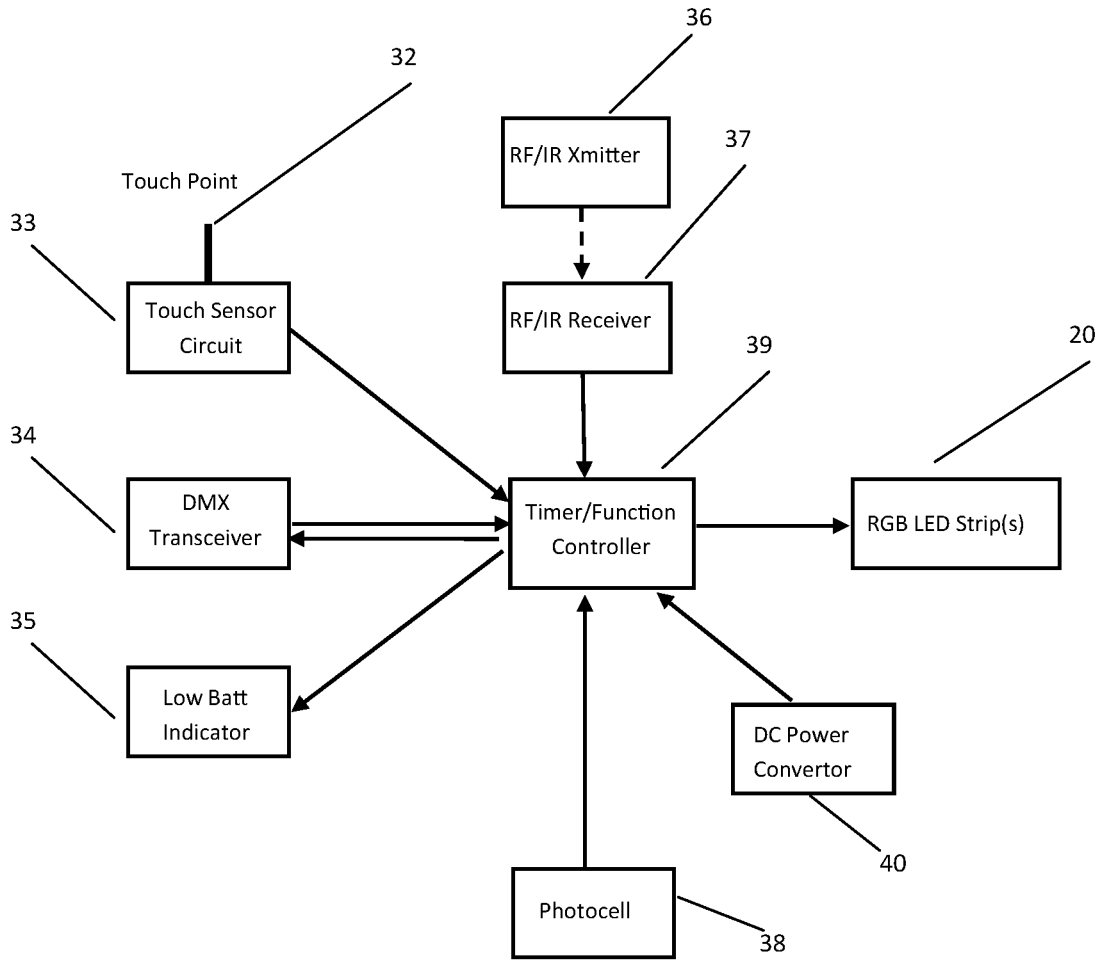
FIG. 6 is a block diagram of the flame simulation apparatus control system with alternative inputs and a related output according to the embodiment of the disclosure shown in FIG. 1.
Figure 7:
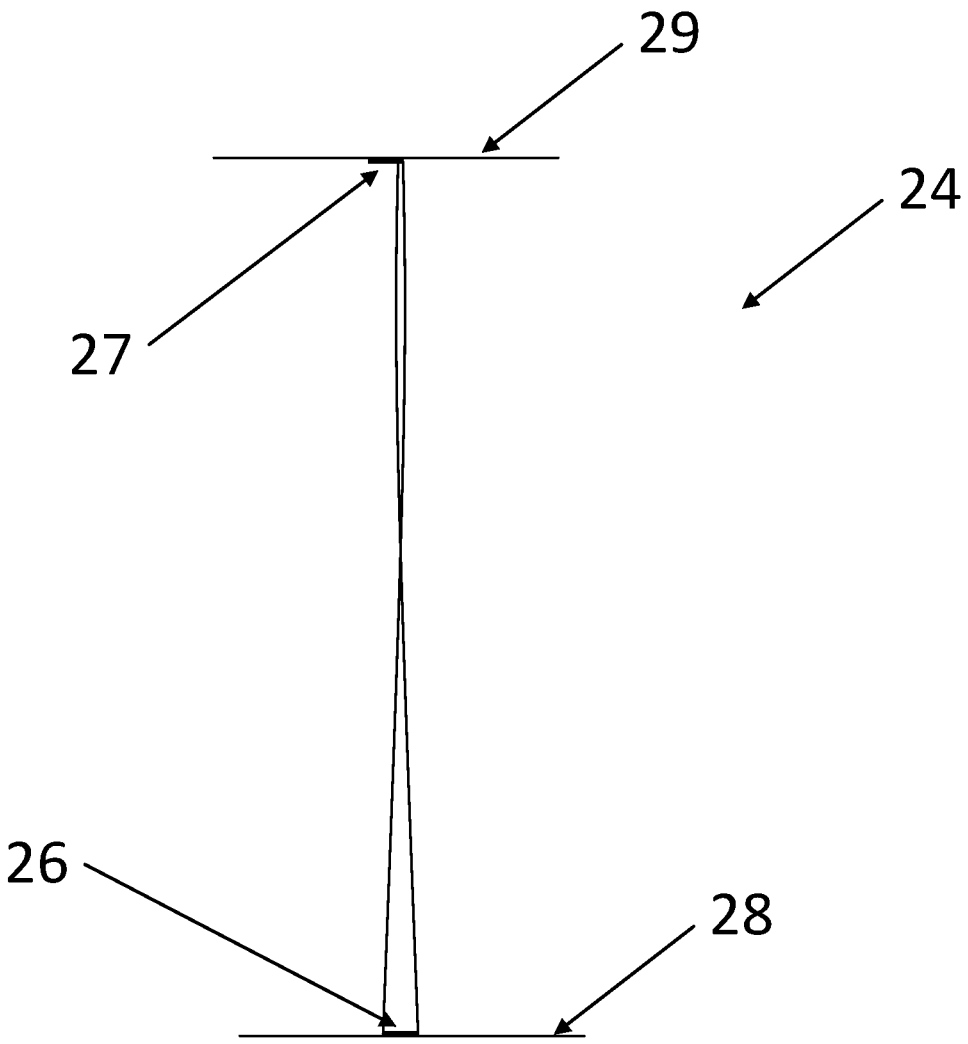
FIG. 7 is a front view in elevation of a LED assembly support strip according to the embodiment of the disclosure shown in FIG. 1.

Referring now to FIG. 6., the flame-effect apparatus is controlled electronically via several components. Touch point 32 and touch sensor circuit 33 are used as alternate input means to control functions including, but not limited to, controlling color, brightness, light output modes or other desirable functions. Touchpoint 32 may be a metal tab or configured as an artificial wire wick. A DMX protocol transceiver 34 is an alternate method of controlling color, brightness, light output modes or other desirable functions.

The system may be battery powered with a Low Battery Indicator 35. A Radio frequency or infrared transmitter or transceiver 36 and corresponding receiver or transceiver 37 may be incorporated to further control functions such as, but not limited to, controlling color, brightness, light output modes or other desirable functions. An additional input such as photocell 38 can be used to automatically adjust the brightness or color of flame-effect assembly 10 when reacting to ambient light conditions. The Function Controller 39 accepts all inputs and also drives LED assembly 20 through a flame emulation algorithm. A DC power supply 40 may be a battery or an AC/DC convertor to provide power for the apparatus. It will apparent to those skilled in the art that many other types of sensor inputs and other modifications may be made without departing from the true spirit and scope of the present disclosure.

The detailed description in connection with the appended drawings is intended as a description of the multiple embodiments of an artificial flame device, and is not intended to represent the only form in which the present disclosure may be constructed or utilized. The description sets forth the functions of the artificial flame device in connection with the illustrated embodiment. It is to be understood, however, that the same or equivalent functions may be accomplished by different embodiments also intended to be encompassed within the scope of the present disclosure. It is further understood that the use of relational terms such as first and second, distal and proximal, and the like are used solely to distinguish one element from another without necessarily requiring or implying any actual such relationship or order between the elements.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What I claim as new and desire to secure by United States Letters Patent is:

1. A flame-effect apparatus comprising:

a housing defining a chamber;

a first lens having a first lens diameter and a first lens longitudinal axis, wherein the first lens defines a first lens chamber secured in the housing;

a second lens having a second lens diameter smaller than the first lens diameter and a second lens longitudinal axis, wherein the second lens defines a second lens chamber and is secured within the first lens chamber;

an LED assembly comprising a plurality of individually controllable LEDs, wherein the LED assembly is secured within the second lens chamber; and, a control assembly secured in the housing and electrically connected to the LED assembly; wherein the longitudinal axis of the first lens is parallel to the longitudinal axis of the LED assembly, and wherein the longitudinal axis of the second lens is not parallel to the longitudinal axis of the first lens.

2. The flame-effect apparatus of claim 1 wherein the first lens is a lenticular lens formed with a first plurality of parallel ribs.

3. The flame-effect apparatus of claim 2 wherein the first plurality of parallel ribs are arranged on the first lens oriented orthogonal to the first lens longitudinal axis.

4. The flame-effect apparatus of claim 2 wherein the first plurality of parallel ribs are arranged on the first lens oriented at an angle to the first lens longitudinal axis.

5. The flame-effect apparatus of claim 2 wherein the second lens is a lenticular lens formed with a second plurality of parallel ribs.

6. The flame-effect apparatus of claim 5 wherein the second plurality of parallel ribs are arranged on the second lens oriented orthogonal to the first lens longitudinal axis.

7. The flame-effect apparatus of claim 5 wherein the first plurality of parallel ribs are arranged on the first lens oriented at an angle to the first lens longitudinal axis.

8. The flame-effect apparatus of claim 1 wherein the individually controllable LEDs are RGB LEDs.

9. The flame-effect apparatus of claim 1 further comprising a control circuit and algorithm programmed to simulate a flame in motion, wherein the control circuit drives a sequential LED algorithm to turn on the individually controllable LEDS in random patterns of variable groupings that randomly vary in length and number to stimulate variances in heat temperature of the flame as it moves from an ignition point.

10. The flame-effect apparatus of claim 9 wherein the control circuit drives and controls a speed of repetition of the random patterns from the ignition point.

11. The flame-effect apparatus of claim 10 wherein the control circuit varies the individually controllable LED colors based on the simulated variances in heat temperature during the process.

12. The flame-effect apparatus of claim 9 wherein the control circuit is programmed to perform a task selected from the group consisting of to turn the individually controllable LEDs on and off, to turn the individually controllable LEDs on and off according to a sequence, to change a color of some or all of the individually controllable LEDs by a manual or remote control, to select or modify an LED activation sequence algorithm, to selectively turn on all the individually controllable LEDs to a steady on state by a manual or remote control and combinations thereof.

13. The flame-effect apparatus of claim 1 further comprising a shroud over the LED assembly and first and second lenses, wherein the shroud is transparent or translucent for light transmission, and wherein the shroud is sufficiently rigid to provide a structural means of assembly.

14. The flame-effect apparatus of claim 1 wherein the LED assembly is configured in a helix formation.

15. The flame-effect apparatus of claim 1 further comprising a power interface electronically connected to the control assembly, wherein the power interface comprises an electrical connection to a power source selected from the group consisting of an on-board, battery, an external battery, a solar power source, an AC power source and combinations thereof.

16. The flame-effect apparatus of claim 1 further comprising a support strip secured in the housing.

17. The flame-effect apparatus of claim 16 wherein the support strip is rigid and formed into a helix, wherein the LED assembly is secured to the support strip.

18. The flame-effect apparatus of claim 16 wherein an end of the support strip is secured to an inner wall of the first lens.

19. The flame-effect apparatus of claim 1 further comprising a top cap secured to the top end of the housing.

20. The flame-effect apparatus of claim 19 further comprising a bottom cap secured to a bottom end of the housing, wherein the bottom cap defines a bottom cap chamber for receiving the control assembly.

* * * * *